US006592690B1

(12) United States Patent
Weis et al.

(10) Patent No.: US 6,592,690 B1
(45) Date of Patent: Jul. 15, 2003

(54) METHOD FOR HARDENING RING-SHAPED GROOVES BY MEANS OF LASER BEAMS

(75) Inventors: Michael Weis, Stuttgart (DE); Karl Pfeil, Stuttgart (DE)

(73) Assignee: Mahle GmbH, Stuttgart (DE)

( * ) Notice: Subject to any disclaimer, the term of this patent is extended or adjusted under 35 U.S.C. 154(b) by 0 days.

(21) Appl. No.: 10/019,813

(22) PCT Filed: Mar. 21, 2000

(86) PCT No.: PCT/DE00/00919

§ 371 (c)(1),
(2), (4) Date: Oct. 25, 2001

(87) PCT Pub. No.: WO00/65104

PCT Pub. Date: Nov. 2, 2000

(30) Foreign Application Priority Data

Apr. 26, 1999 (DE) ..... 199 18 808

(51) Int. Cl.[7] ..... C21D 9/00; C21D 1/06

(52) U.S. Cl. ..... 148/565; 92/125; 219/121.76; 219/121.79; 219/121.85

(58) Field of Search ..... 148/565; 92/125; 219/121.76, 121.77, 121.78, 121.85

(56) References Cited

U.S. PATENT DOCUMENTS 5,515,770 A 5/1996 Clark et al.
5,566,437 A * 10/1996 Jaeggi ..... 29/33 R

FOREIGN PATENT DOCUMENTS

JP 61 149424 7/1986
JP 02 104612 7/1990
JP 02104612 A * 10/1990

OTHER PUBLICATIONS

Liu et al., Research on wear resistance of laser quenched Groove of the piston head in large diesel engine, Jixie Gongyebu Shanghai Cailiao, 22(5), 26–28 (chinese) 1998.*

* cited by examiner

*Primary Examiner*—Roy King
*Assistant Examiner*—David H. LeRoy
(74) *Attorney, Agent, or Firm*—Collard & Roe, P.C.

(57) ABSTRACT

A method for hardening the grooves of steel pistons of steel piston heads whereby hardening of the bottom of the grooves is avoided. The laser beam is directed onto the sides of the groove in an approximately tangential direction in relation to the outer diameter of the piston.

8 Claims, 1 Drawing Sheet

METHOD FOR HARDENING RING-SHAPED GROOVES BY MEANS OF LASER BEAMS

CROSS-REFERENCE TO RELATED APPLICATIONS

Applicants claim priority under 35 U.S.C. §119 of German Application No. 199 18 808.4 filed Apr. 26, 1999. Applicants also claim priority under 35 U.S.C. §120 of PCT/DE00/00919 filed Mar. 21, 2000. The international application under PCT article 21(2) was not published in English.

The application relates to a method for hardening the ring-shaped grooves of the head of a piston made of steel, of a steel piston, of a bottom part made of steel, or of steel piston heads by means of laser beams.

Such methods are known from U.S. Pat. No. 5,515,770 and JP-A 1-149424. It is important in connection with such methods, in the normal case, that the front edge of the groove is not melted down and that the bottom of the groove is not hardened because a higher level of stress exists there. In order to prevent the front edge of the groove from being melted down, the edge is kept shaded according to the JP-patent (FIG. 2) by means of a special device. The position of the laser beam is precisely specified in the U.S. patent.

The feature that is common to both methods is that the laser beam is incident upon the center axis of the piston in a radial manner, so that with an imagined extension of the laser beam, the latter intersects the center axis of the piston, and that a graphite coating increasing the absorption is applied before the hardening process is carried out.

The invention is dealing with the problem of preventing the bottom of the groove from being hardened in the application of methods of the type specified above. Said problem is solved by the characterizing feature of claim 1. Advantageous further developments of the invention are the objects of the dependent claims.

Any reflection of the laser beams in the direction toward the bottom of the groove is safely avoided by guiding the laser beam in an approximately tangential manner. According to claim 2, any reflection in the direction of the given opposite flank of the groove is safely avoided as well because the angle of impact is correspondingly smaller. Guiding the laser beam in a tangential manner means that the laser beams projected onto the plane of the ring-shaped grooves intersect the piston or head of the piston only peripherally in the area of its ring-shaped grooves as secants. In other words, the laser beam is directed onto the piston in about the peripheral direction.

Figure 1:
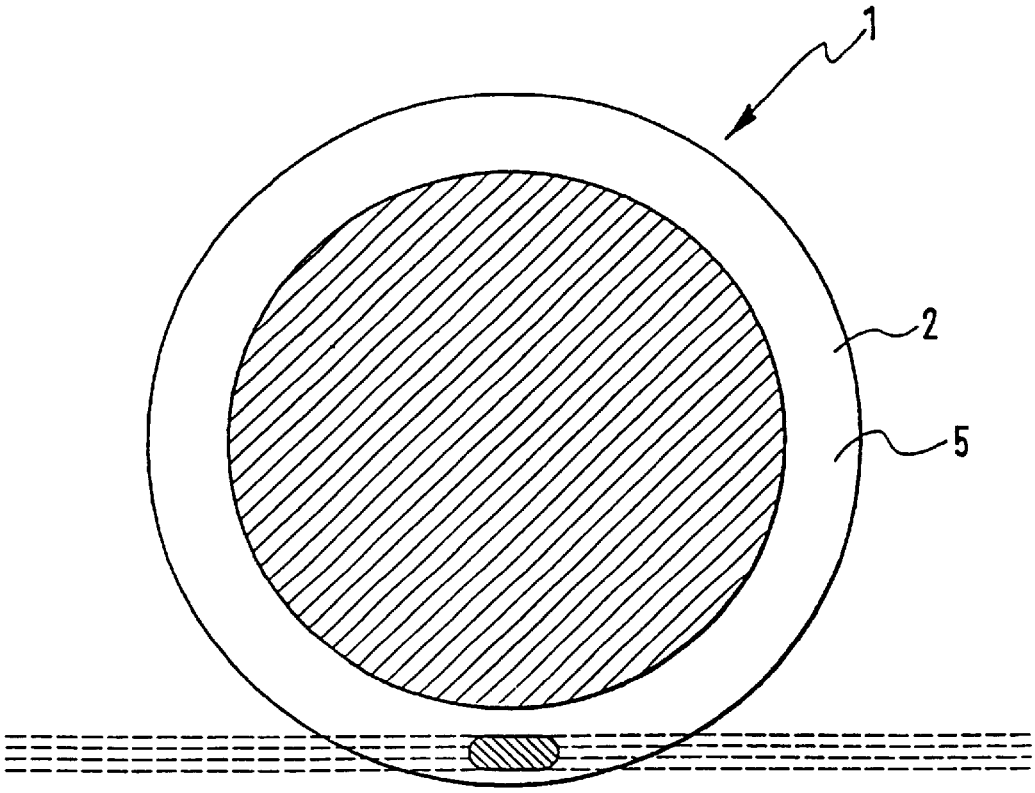
Figure 2:
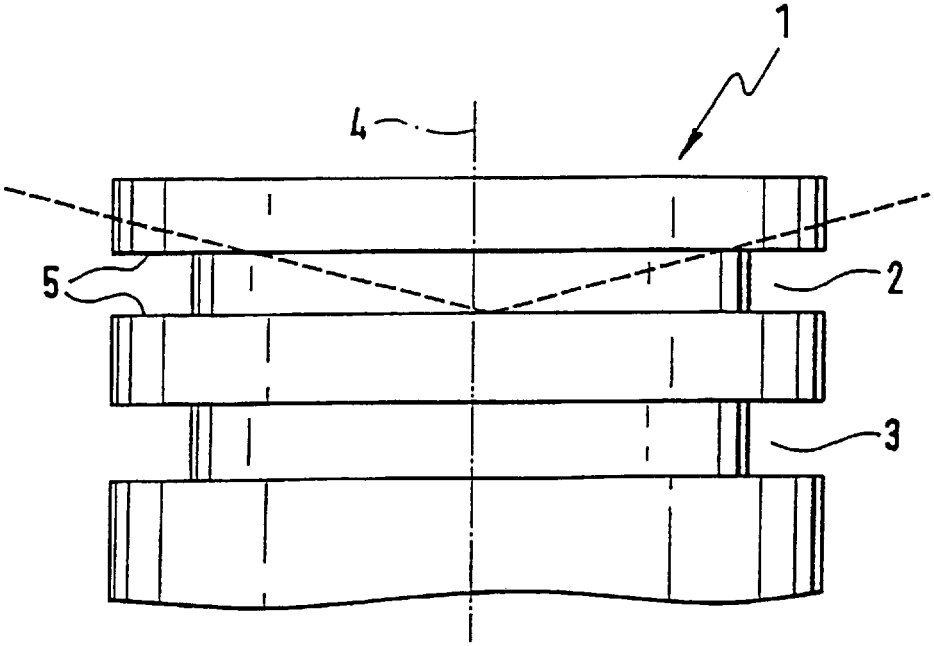

The invention is explained in greater detail in the following with the help of a drawing, in which:

FIG. 1 is a top view of the location of the laser beam in relation to the head of the piston; and FIG. 2 is a side view of the location of the laser beam in relation to the head of the piston.

A piston head 1 with the ring-shaped grooves 2 and 3 is received in a rotatable manner in a clamping device not shown. The piston head 1 is shown cut open in the plane of the groove. The grooves of the piston head are hardened by means of laser beams. The path of the laser beam is indicated by dashed lines. The laser beam is directed in about the tangential direction onto the flank 5 of the groove based on the outside diameter of the piston head 1.

FIG. 2 shows the center axis 4 of the piston. The angle between the plane of the flank of the groove and the laser beam is relatively small and amounts to less than 15°.

What is claimed is:

1. A method for hardening by means of laser beams ring shaped grooves of a head of a piston made of steel, of a single piece steel piston, a piston head made of steel, or of a steel bottom part of a piston, the method comprising directing the laser beams onto the piston in about a peripheral direction at a relatively small angle based on a plane of a flank of the groove, so that beams reflected by the flank of the groove neither impinge upon a bottom of the groove nor upon the other flank of the groove.

2. The method according to claim 1, wherein the laser beam projected onto the plane of the ring-shaped grooves intersects the piston head only peripherally in its ring-shaped grooves as secants.

3. The method according to claim 1, wherein no surface coating for increasing the absorption is applied to the areas to be hardened.

4. The method according to claim 1, wherein both flanks of the groove are hardened at the same time.

5. A method for hardening by means of laser beams ring shaped grooves of a head of a piston made of steel, of a single piece steel piston, a piston head made of steel, or of a steel bottom part of a piston, the method comprising directing the laser beams onto the piston in about a peripheral direction, wherein both flanks of the groove are hardened at the same time.

6. The method according to claim 5, wherein the laser beams projected onto the plane of the ring-shaped grooves intersects the piston head only peripherally in its ring-shaped grooves as secants.

7. The method according to claim 5, wherein the laser beams are directed onto a flank of the groove at a relatively small angle based on a plane of the flank of the groove, so that the beams reflected by the flank of the groove neither impinge upon the bottom of the groove nor upon the other flank of the groove.

8. The method according to claim 5, wherein no surface coating for increasing the absorption is applied to the areas to be hardened.

* * * * *